United States Patent [19]

Carter

[11] 4,237,442

[45] Dec. 2, 1980

[54] ELECTRICAL RESISTANCE ELEMENT FOR VARIABLE RESISTANCE DEVICES

[75] Inventor: Jerry L. Carter, Cerritos, Calif.

[73] Assignee: Carrier Corporation, Syracuse, N.Y.

[21] Appl. No.: 15,025

[22] Filed: Feb. 26, 1979

[51] Int. Cl.[3] ..... H01C 10/40

[52] U.S. Cl. ..... 338/180; 338/138; 338/176; 338/142; 338/320; 338/314; 338/171

[58] Field of Search ..... 338/180, 181, 171, 202, 338/314, 138, 176, 307, 308, 142, 320

[56] References Cited

U.S. PATENT DOCUMENTS

| | | | |
|---|---|---|---|
| 2,118,072 | 5/1938 | Deutschmann | 338/142 |
| 2,134,870 | 11/1938 | Fruth | 338/142 |
| 3,379,567 | 4/1968 | Wright | 338/138 X |
| 3,464,050 | 8/1969 | Lawson | 338/89 |
| 3,479,216 | 11/1969 | Counts et al. | 338/308 X |
| 3,492,623 | 1/1970 | Yamada | 338/162 |
| 4,039,994 | 8/1977 | Ward | 338/89 |
| 4,051,453 | 9/1977 | Barden | 338/171 |

FOREIGN PATENT DOCUMENTS

| | | | |
|---|---|---|---|
| 1516929 | 2/1968 | France | 338/138 |
| 479046 | 1/1938 | United Kingdom | 338/138 |

*Primary Examiner*—C. L. Albritton

*Attorney, Agent, or Firm*—J. Raymond Curtin; Donald F. Daley

[57] ABSTRACT

An electrical resistance element for use in variable resistance devices such as trimmers and potentiometers, having two or more resistance materials on a non-conducting base. The resistance materials are aligned along a path of travel of a movable wiper or contact to provide a series of variable linear resistances or a non-linear resistance. The interface between the resistance materials is arranged so that individual contact elements of the wiper traverse the interface at different times.

8 Claims, 8 Drawing Figures

ELECTRICAL RESISTANCE ELEMENT FOR VARIABLE RESISTANCE DEVICES

BACKGROUND OF THE INVENTION

This invention relates to electrical resistance elements and to the method of making such elements, and more specifically to printed resistors used in trimmers or potentiometers or other devices, where a series of variable linear resistances or a variable, non-linear resistance is desired.

Variable resistance elements are either of the linear type wherein, the resistance is a direct function of the position of the electrical contact member, or wiper, on the resistance element, or the non-linear type wherein the resistance is a non-linear function of the contact position. Non-linear elements have been made by several methods, as for example, constructing a resistance track of molded conductive plastic of varying thickness, irregularly shaping a conductive section forming a resistance track, or constructing electrical shunts along a resistance track. One of more common types of non-linear elements is constructed of two different resistance materials along the resistance track. Each separate material has a linear relationship of resistance to wiper position, however, each material is selected to more closely approximate a desired non-linear function than could be provided with a single resistance material. The disadvantages to this type of arrangement are that the resultant output does not sufficiently reduce the difference between the actual resistance and the desired resistance, there is a noise spike at the point where the two elements join.

In devices using the type of element having two or more resistance materials which change linearly with the change in wiper position, the resistance element is usually formed of two materials such as cermet, deposited in line along the element track. The wiper is moved along the surface of the element to change the resistance. As the wiper moves along the element surface the total resistance in the circuit follows a linear rate of change until the wiper encounters the second resistance material. With the wiper in contact with the second material the change of the resistance is still linear but the rate of change is different from the rate of change when the wiper was in contact with the first material. In this way a non-linear output of the device is approximated. To more closely approximate a desired non-linear output, it has been necessary to deposit additional, different, resistance materials. The present invention allows a non-linear rate of change or numerous linear rates of change of resistance to be accomplished with two resistance materials and only one firing of both resistance materials. Other methods of producing non-linear outputs have been attempted, as for example producing a second parallel low resistance material adjacent to the resistance track and tailoring the low resistance track to the output desired. See, for example, U.S. Pat. No. 3,379,567. This type of device is essentially a multiple shunt device.

SUMMARY OF THE INVENTION

It is an object of this invention to improve variable resistance elements.

It is a further object of this invention to provide a non-linear resistance element for potentiometers and a method of making variable resistance elements for potentiometers which closely approximate or duplicate a desired non-linear output.

These and other objects of this invention are attained by applying two or more resistive materials in line onto a non-conductive base to form a variable resistance element track which has a desired non-linear function. A first resistance material is applied to the non-conductive base covering a portion of the desired track and dried or heated to glaze the material or totally fired. A second resistance material is applied to the base covering the remaining portion of the track. The line forming an interface between the two materials is shaped, to extend across the track in a manner to provide the resistance output desired as a multiple fingered contact traverses the track. The material is then fired to solidify the entire track.

DESCRIPTION OF THE PREFERRED EMBODIMENT

Figure 1:
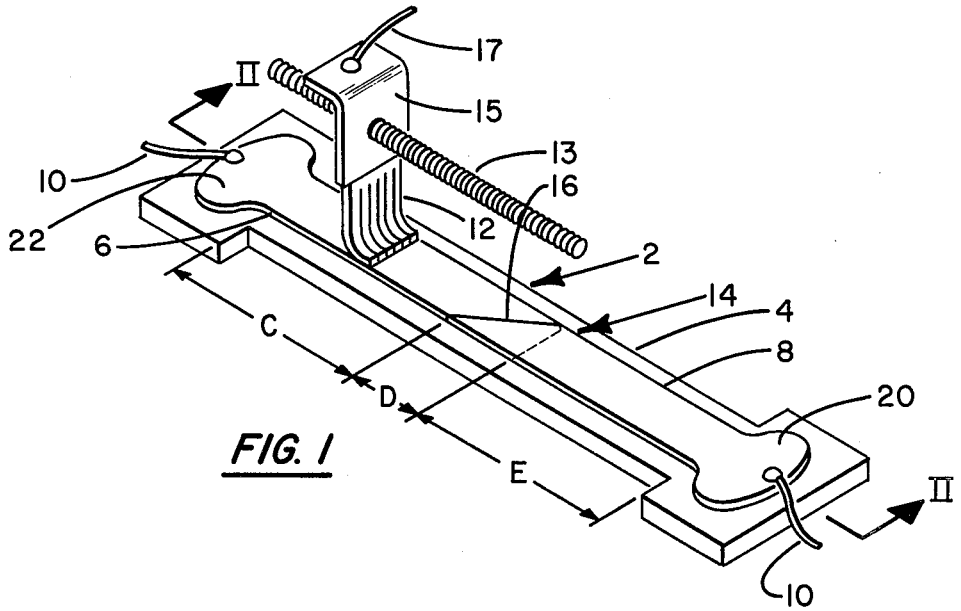
FIG. 1 is an isometric view of a potentiometer embodying the present invention.
Figure 2:
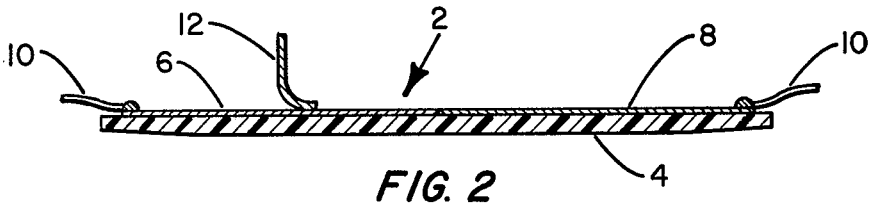
FIG. 2 is a sectional view of the potentiometer shown in FIG. 1 taken along line II—II of FIG. 1.

Referring now to FIGS. 1 and 2 of the drawings there is shown a resistance element 2 of type suitable for use in potentiometers or other variable resistance devices. An electrically non-conductive base 4 is usually a ceramic material but may be any suitable electrically non-conducting material. A first layer of electrically conducting material 6, is applied to the base 4 by any well known deposition process, such as silk screening. A second layer of electrically conducting material 8, having different conductive characteristics than the first material is also applied to the base 4 in contact with the first material. Both materials may be any suitable conducting material, such as cermet, in which the composition can be controlled to give the desired resistance characteristics. The two conductive materials constitute a resistance track generally referred to as 14.

Cermet material comprises a heterogenious mixture of non-conducting material and conducting metals. The non-conducting material is a ceramic type material such as glass and the layer is formed by heating the metal-glass mixture at least to the melting point of the glass to create a glossy phase material with a smooth hard surface. Various ceramic materials are suitable for use in this manner, particularly those having a smooth fine textured surface and which is impervious to moisture and other liquids.

Electrically conductive terminals 20 and 22 are first applied to opposite ends of the base 4 and fired. Then the two layers 6 and 8 are applied in contact with the conductive terminals 20 and 22. Electrical conductors 10 are connected to the conductive terminals 20 and 22. A multifingered contact or other suitable wiper 12 is mounted above the track 14 in contact therewith. The wiper 12 extends across the track and is movable over the length of the track. The multifingered wiper 12 is moved along the track by a threaded drive shaft 13 or other moving means to vary the resistance of the potentiometer. The shaft 13 can be connected to a suitable conductive block 15 which supports the wiper 12. An electrical connector 17 is connected to the block 15 to provide a circuit through the wiper 12 and the track 14. It can be seen in FIG. 1 that the resistance tracks 6 and 8 have a slanted interface or knit line 16 joining the two tracks. The knit line 16, together with the tracks 6 and 8, form, in the resistance track 14, three linear sections shown as C, D, and E. The first section C extends between the first conductive terminal 20 and the beginning of the slanted knit line 16. The second section D is formed by the portion of the resistance track 14 extending between the lower end or beginning of the slanted line 16 and its upper end. The third section E extends between the upper end of the slanted line 16 and the second conductive terminal 22.

Figure 7:
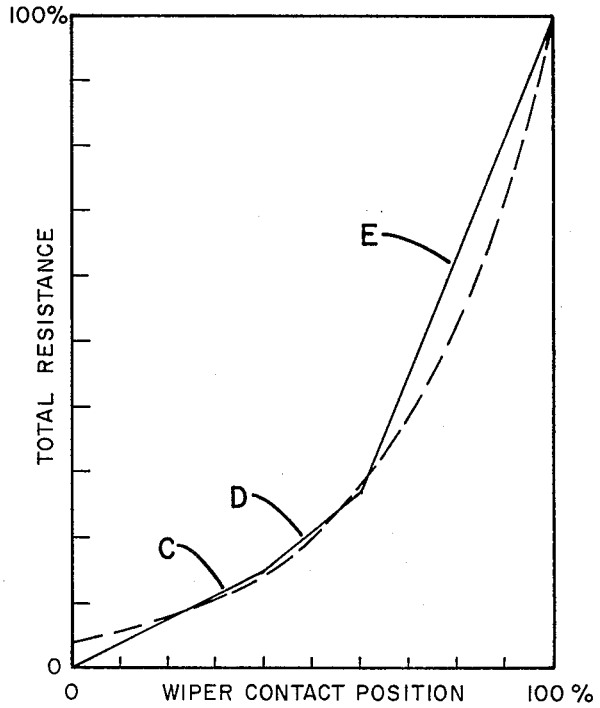
FIG. 7 is an illustrative curve showing the output function achievable with potentiometer shown in FIG. 1.
Figure 3:
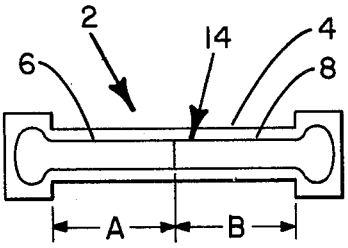
FIG. 3 PRIOR ART
FIG. 3 is a plan view of a conventional prior art resistance element included herein for purposes of explanation.
Figure 6:
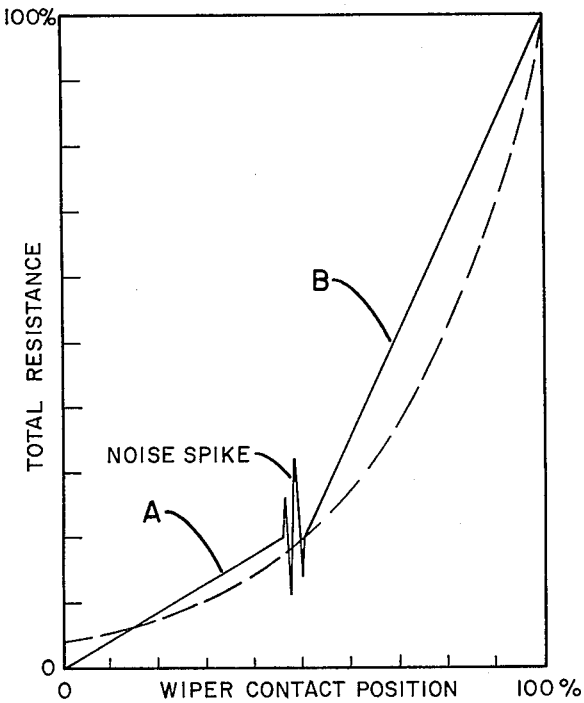
FIG. 6 is an illustrative curve providing the output function achievable with the resistance element shown in FIG. 3.

As can be seen from the prior art shown in FIG. 3 it is conventional to apply two conducting materials to a non-conducting base with a straight knit line extending across the two surfaces. In this situation when the wiper 12 crosses the knit line all fingers of the wiper cross at essentially the same time and a sharp noise spike, as shown in the chart in FIG. 6, is created. The chart in FIG. 6 shows the change in resistance relative to wiper position. The solid line A shows the linear change in resistance as the wiper traverses the portion of the track labeled A in FIG. 3 and the solid line B shows the linear change in resistance as the track traverses the portion indicated as B in FIG. 3. The curved dotted line shown in FIG. 6 is the desired non-linear resistance for the particular potentiometer. Lines A and B are created to approximate the non-linear output. With the slanted knit line 16 shown in FIG. 1 the individual fingers of the multifingered contact 12 sequentially crossed the knit line thereby eliminating the noise spike. FIG. 7 shows the resistance versus wiper position chart for a track constructed in accordance with FIG. 1. The straight linear sections C, D, and E, are shown in solid lines and the desired non-linear resistance line is shown as dotted. It can be seen comparing FIG. 6 and 7 that the potentiometer output more closely approximates the desired non-linear output and eliminates the noise spike between the linear sections.

Figure 4:
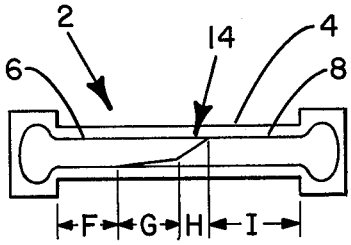
FIG. 4 is a plan view of an embodiment of a resistance element of the invention.
Figure 8:
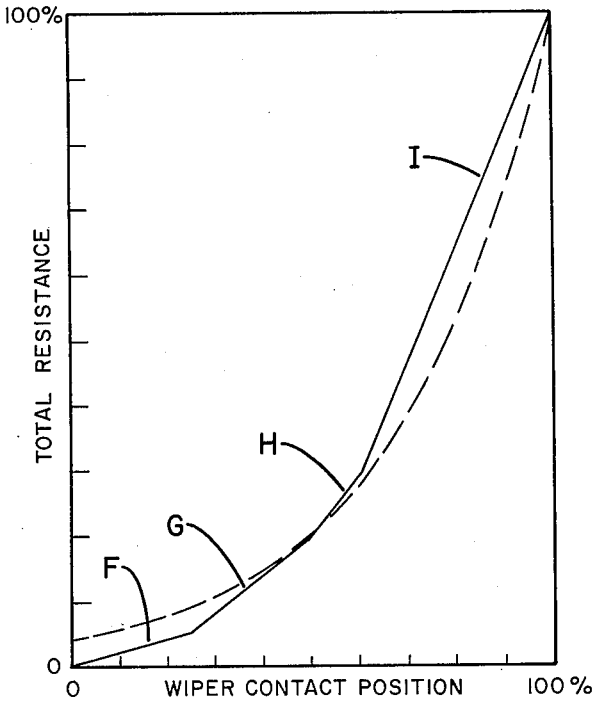
FIG. 8 shows an illustrative curve providing the output function achievable with the resistance element shown in FIG. 4.

FIG. 4 and FIG. 8 show a resistance device constructed with a knit line having two different slopes thus creating four different linear outputs F, G, H, and I. By varying the slope of the knit line it is possible to create any desired type of output at any given wiper position.

The electrical resistance of the track in an element of the type shown herein is a function of the length and the resistance of the material in the track. The length is determined by the position of the wiper along the track and the resistance of the material is determined by the metal content of the compositions used to make up the track. For example, the resistance of zones C and E in FIG. 1 is directly related to the resistance of the material times its length whereas in zone D the resistance is a function of the resistance of the geometric mixing of the two materials times the length of the one. As can be seen from FIG. 1 the resistance will vary as the wiper moves across zone D as a result of the change in length of the resistance track and as a result of the continually changing geometric mix of the materials in zone D. If desired, the geometric mixing of the two materials may be continuously varied to produce a curved knit line of the type shown in FIG. 5. In this manner a non-linear output may be achieved across the entire track or any portion thereof.

Figure 5:
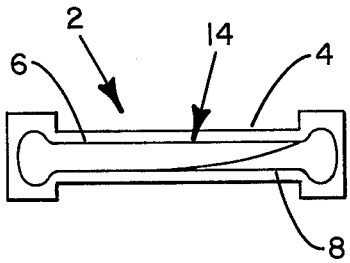
FIG. 5 is a plan view of another embodiment of the resistance element according to the invention.

It should be noted that three or four linear section were chosen for convenience in showing the general concept of approximating a desired non-linear output. While four linear sections do yield a functional trimmer, more linear sections may be used, and in the extreme, the line forming the interface between the two materials could be a smooth curve traversing the resistance track, as it is shown in FIG. 5. Also, additional materials of different composition and resistance characteristics may be applied sequentially along the track with interfaces between each material shaped to produce a composite resistance of the two adjoining materials. The resistance element and the resistance track shown herein are formed in a straight line; however, the element and track may be circular or curved as in conventional in the potentiometer art without departing from the spirit of the invention.

In making the resistance element 2, a base 4 is formed of ceramic material which is molded, fired and then may be ground or lapped to provide a smooth planar surface for supporting the resistance track. The conductive terminals 20 and 22 are formed by applying or printing any of the well-known electrically conducting materials such as silver or other metals in the form of a paste, over the non-conductive base 4 and then firing the base with the paste thereon, to provide a film of metal on the surface of base 4. After printing and firing the conductive terminals 20 and 22 the first resistance layer 6 usually of the low resistance material is similarly printed on the base 4 adjacent to the inner edge of the first terminal 20. Then the first resistance layer 6 is glazed by drying or quickly heating via infrared or other heating source to provide a fusion of the track surface. As used herein the term glaze means dry and, or heat the material to just fuse the track surface prior to firing the element for complete fusion of the material. This produces a surface hardness prior to firing. For some cermet compositions the glazing operation may be the same process as used in the final firing operation. The second resistance layer 8 usually of the high resistance material is then printed on the base 4 adjacent to and in contact with the first layer 6. After this step the entire unit including both resistance layers is fired in a conventional kiln. During firing the glazed surface of the first resistance layer is remelted and both layers are fused simultaneously. Because both resistance layers are fused at the same time the two layers make a smooth junction along the knit line between them. After applying and firing resistance films to the non-conductive base the conductors 10 are embedded in the conductive terminals 20 and 22.

While the present invention has been described in connection with particular embodiments, it is to be understood to those skilled in the art that various modifications may be made without departing from the scope of the appended claims.

What is claimed is:

1. An electrical resistance element of the type used in variable resistance devices wherein the resistance element forms a track for a multi-fingered electrical contact which is movable along the track to change the electrical resistance of the device comprising, an electrically non-conductive substrate, a track on the surface of the substrate for movement of a multi-fingered electrical contact, said track comprising a series of materials of different electrical resistances deposited on the substrate in sequential, abutting relationship, forming an interface between each adjacent material, the interface between the materials being shaped to form a transition section of the track wherein the multi-fingered contact moving along the track contacts both adjacent materials simultaneously with the ratio of each material being contacted changing as the multi-finger contact moves through the transition section whereby the electrical resistance of the device is changed according to the shape of the interface.

2. The resistance element of claim 1 wherein the track includes two materials having different electrical resistivity and the interface between the two materials is a straight line extending across the track at an angle relative to the multi-fingered contact whereby the contact incrementally crosses the interface.

3. The resistance element of claim 1 wherein the track includes a high resistance material and a lower resistance material and the transition section between the two materials includes a series of interface lines between the materials with each interface line being at different angles relative to the multi-fingered contact to produce different rates of change of the resistance as the multi-fingered contact traverses the section.

4. The resistance element of claim 1 wherein the track includes two materials having different electrical resistivity and the interface between the two materials is a curved line extending across the track, said curved line being shaped to produce a non-linear rate of change of the composite resistance as the multi-fingered contact traverses the interface.

5. A variable resistance device comprising, an electrical resistance element, and a multi-fingered electrical contact member adapted to traverse the surface of the resistance element to vary the electrical resistance of the device in relation to the position of the contact member along the surface of the resistance element, said electrical resistance element including, an electrically non-conductive substrate having deposited thereon a film of electrically resistant material forming a track for said contact member, the film of electrically resistant material comprising at least two materials having different electrical resistances arranged serially along the track with each material in abutting contact with each adjacent material forming an interface between the materials, the interface between the materials being shaped to form a transition section of the track wherein the electrical contact member is in physical, electrical contact with each material in the section simultaneously to produce a composite resistance across the device which continuously changes as the contact member moves through the section.

6. The variable resistance device of claim 5 wherein the interface between the materials includes a series of straight lines extending across the track at different angles to the multi-fingered contact.

7. The variable resistance device of claim 5 wherein the interface between the materials includes a straight line extending across the track at an angle to the multi-fingered contact.

8. The variable resistance device of claim 5 wherein the interface between the materials includes a curved line extending across the track.

* * * * *

UNITED STATES PATENT AND TRADEMARK OFFICE

CERTIFICATE OF CORRECTION

PATENT NO. : 4,237,442

DATED : December 2, 1980

INVENTOR(S) : JERRY L. CARTER

It is certified that error appears in the above-identified patent and that said Letters Patent are hereby corrected as shown below:

At [73] change "Carrier Corporation,Syracuse, N.Y." to --Spectrol Electronics Corporation, City of Industry, California--.

Signed and Sealed this

*Seventeenth* Day of *March 1981*

[SEAL]

*Attest:*

RENE D. TEGTMEYER

*Attesting Officer*

*Acting Commissioner of Patents and Trademarks*